US007156133B2

(12) United States Patent
McLaughlin et al.

(10) Patent No.: US 7,156,133 B2
(45) Date of Patent: Jan. 2, 2007

(54) LIQUID REPLENISHMENT SYSTEM

(76) Inventors: John E. McLaughlin, 3 Country Lane, Lake Grove, NY (US) 11755; Neocles G. Athanasiades, 6 Mayeeck Dr., Setauket, NY (US) 11723; Toh M. Meng, 15 Sunflower Dr., Hauppauge, NY (US) 11788

( * ) Notice: Subject to any disclaimer, the term of this patent is extended or adjusted under 35 U.S.C. 154(b) by 371 days.

(21) Appl. No.: 10/889,347

(22) Filed: Jul. 13, 2004

(65) Prior Publication Data

US 2006/0011260 A1 Jan. 19, 2006

(51) Int. Cl.
*B65B 1/30* (2006.01)

(52) U.S. Cl. ..... 141/198; 141/95; 141/192; 141/301; 137/393; 137/395

(58) Field of Classification Search ..... 141/4, 141/5, 67, 94, 95, 192, 198, 301; 169/26, 169/30, 71, 76; 137/386, 393, 395
See application file for complete search history.

(56) References Cited

U.S. PATENT DOCUMENTS 5,649,577 A * 7/1997 Farkas ..... 141/198
6,695,017 B1 * 2/2004 Liedtke ..... 141/5
6,796,627 B1 * 9/2004 Kimura et al. ..... 347/7

* cited by examiner

*Primary Examiner*—Timothy L. Maust
(74) *Attorney, Agent, or Firm*—Frank L. Hart

(57) ABSTRACT

Apparatus is provided for controllably delivering liquid, preferably foam producing liquid, from a remote supply tank to a holding tank for replenishment of liquid in the holding tank. The apparatus utilizes a pressurized air source of a vehicle to supply the energy to move the liquid. A liquid level sensing, signaling element is adapted to automatically control the filling of the holding tank and terminating operation when the holding tank is no longer being replenished.

4 Claims, 2 Drawing Sheets

LIQUID REPLENISHMENT SYSTEM

CROSS REFERENCE TO RELATED APPLICATION

Not applicable

STATEMENT REGARDING FEDERALLY SPONSORED RESEARCH OR DEVELOPMENT

Not applicable

INCORPORATION - BY - REFERENCE OF MATERIAL SUBMITTED ON A COMPACT DISC

Not applicable

BACKGROUND OF THE INVENTION

1. Field of the Invention

Figure 1:
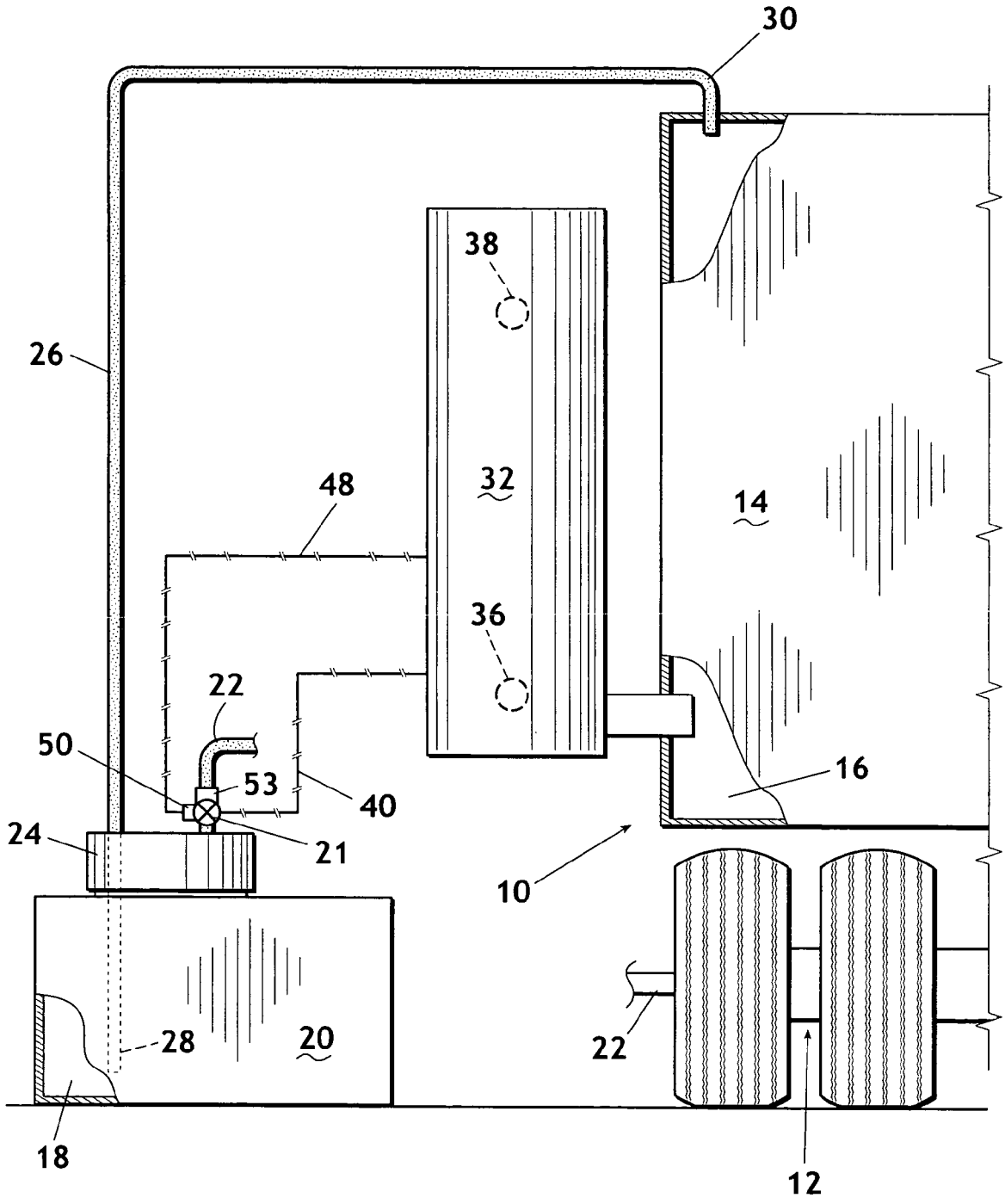

The subject invention relates to apparatus for replenishing liquid in a holding tank from a remotely positioned supply tank. More particularly, the subject invention relates to automatically, controllably delivering foam producing liquid from a supply tank, upwardly and into a holding tank of a fire truck for replenishing foam in the holding tank.

2. Description of Related Art Including Information Disclosed Under 37 CFR 1.97 and 1.98

Foam producing liquid is often carried in a holding tank of a fire truck. Such liquids, when mixed with other fluids, such as water and/or air, produce a foam which is used to extinguish electrical fires and many chemical fires. The holding tank of the fire truck is at an elevated position on the truck and heretofore has required a fireman to climb to the fill opening of the holding tank while carrying the heavy supply tank filled with foam producing liquid.

To so carry the heavy supply tank upwardly to the fire truck holding tank requires a large expenditure of energy, is dangerous, and must often be accomplished in dangerous weather conditions.

By use of the subject invention, the holding tank of the truck is automatically replenished without necessitating the firemen to leave ground level. Further, the fire truck pressurized air source provides the energy to transfer the liquid and such energy is conserved by automatically closing the control valve in response to a satisfactorily filled holding tank or in response to the absence of liquid being transferred.

BRIEF SUMMARY OF THE INVENTION

In one aspect of the invention, the apparatus of this invention is provided for controllably delivering foam producing liquid from a chamber of a supply tank, upwardly and into a chamber of a holding tank of a fire truck. The fire truck has a pressurized air source that passes. via an air hose, through a pressure regulator, a control valve, and into communication with the chamber of the supply tank. The pressurized air forces liquid from the supply tank, through a fill hose and into the holding tank of the fire truck. A liquid level sensing, signaling element is associated with the holding tank and the control valve. The sensing, signaling element has first and second set points and is adapted to respectively open and close the control valve in response to changing liquid levels in the holding tank. In another aspect of the invention, the sensing, signaling element additionally is adapted to close the control valve in response to the absence of fluid entering the holding tank chamber from the supply tank.

BRIEF DESCRIPTION OF THE SEVERAL VIEWS OF THE DRAWING(S)

Figure 2:
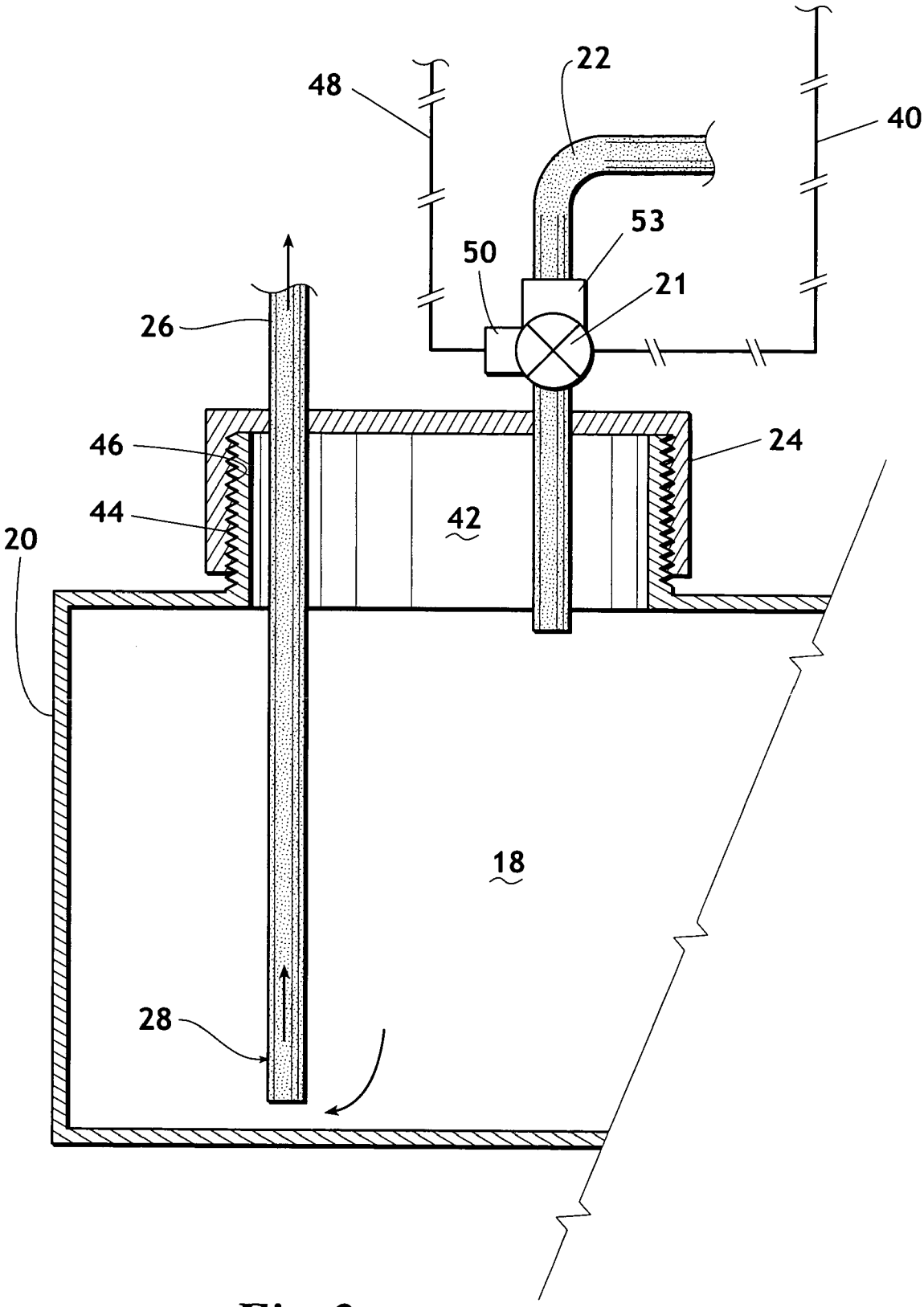

FIG. 1. is a partial view of the apparatus of this invention connected to a fire truck; and FIG. 2 is an enlarged partial view of the end cap and associated elements of this invention.

DETAILED DESCRIPTION OF THE INVENTION

Referring to FIG. 1, a fire truck 10 has a pressurized air source 12 for operating the brakes of the truck 10 and a foam holding tank 14 mounted on the truck has a chamber 16 for receiving liquid, such as foam producing liquid.

Referring to FIGS. 1 and 2, the foam producing liquid is generally transported to the fire truck 10 in the chamber 18 of a supply tank 20. A control valve 21 is connectable to the pressurized air source 12, via air hose 22, and to the supply tank, via cap 24, and into fluid communication with the supply tank chamber 18.

A fill hose 26 has first and second end portions 28,30. One end portion is positionable adjacent the bottom of the supply tank chamber 18 and the other end is positionable in fluid communication with the holding tank chamber 16.

A liquid level sensing, signaling element 32 is connected to the control valve 21 and is connectable in liquid communication with the holding tank chamber 16 via line 34. The sensing, signaling element has first and second set points 36, 38 and is adapted to deliver signals, via line 40, to the control valve 21 and responsively open and close said control valve 21 in response to liquid in the holding tank chamber 16 reaching the representative levels of the respective first and second set points 36,38.

The supply tank 20 generally has a threaded pouring spout 42. The cap 24 has internal threads 44 mateable with the threads 46 of the spout 42. It should be understood however, that the seal of the cap 24 and pour spout 42 can be of other construction without departing from this invention.

In the preferred embodiment of this invention, the liquid level sensing, signaling element 32 continuously measures the liquid level in the holding tank 14 and delivers signals responsive to said measurements. The signals are delivered via line 48 to a timing element 50 that is connectable to the control valve 21. The timing element 50 is actuated in response to receiving signals from the liquid level sensing, signaling element 32 indicating the termination of filling of the holding tank 14 and responsively causes the control valve 21 to close at a preselected time after actuation. By this system, air flow through the control valve 21 is terminated when liquid is not being moved from the supply tank 20 to the holding tank 14. This automatic closing represents the avoidance of waste of energy and wear and tear of equipment.

Since the pressurized air source 12 of the fire tuck 10 generally is in the neighborhood of about 90 psi., it is desirable that a pressure regulator 52 connected to the control valve 21 and air hose 22 at a location upstream of the control valve 21. It is recommended that the air pressure be lowered by the pressure regulator 52 to about 5 psi.

Other aspects, objects and advantages of this invention can be obtained from a study of the drawings, the disclosure, and the appended claims.

SEQUENCE LISTING

Not applicable

What is claimed is:

1. Apparatus for controllably delivering foam producing liquid from a chamber of a supply tank, upwardly and into a chamber of a holding tank of a fire truck for replenishment of foam producing liquid in the holding tank, said fire truck having a pressurized air source and said supply tank having a threaded spout, comprising:

a cap having internal threads mateable with the threads of the supply tank spout;

an air hose connectable at one end to the fire truck pressurized air source and passing through and being connected to the cap;

a pressure regulator connected to the air hose at a middle portion of said air hose;

a control valve connected to and between the pressure regulator and the cap;

a fill hose connected to and passing through the cap, said fill hose having a length sufficient for extending from adjacent the ground upwardly and into communication with the chamber of the fire truck holding tank chamber; and a liquid level sensing, signaling element connectable to the control valve and connectable in liquid communication with the holding tank chamber of the fire truck, said sensing and signaling element having first and second set points and being adapted to respectively open and close the control valve in response to changing liquid levels in the holding tank chamber, said sensing and signaling element additionally being adapted to close the control valve in response to the absence of fluid entering the holding tank chamber from the supply tank.

2. Apparatus for controllably delivering liquid from a remote supply tank to a holding tank for replenishment of liquid in the holding tank, each of said tanks having an internal chamber for holding liquid, comprising:

a pressurized air source;

a control valve connectable to the pressurized air source and being connectable to the supply tank in communication with the supply tank chamber;

a fill hose having first and second ends, one end of said fill hose being positionable adjacent the bottom of said supply tank chamber and the other end positionable in fluid communication with the holding tank chamber; and a liquid level sensing, signaling element connected to the control valve and connectable in liquid communication with the holding tank chamber, said sensing, signaling element having first and second set points and being adapted to deliver signals to the control valve and responsively open and close said control valve in response to liquid in the holding tank chamber reaching the representative levels of the respective first and second set points, wherein the liquid level sensing, signaling element continuously measures the liquid level in the holding tank and delivers signals responsive to said measurements and including a timing element connectable to the control valve and to the liquid level sensing, signaling element, said timing element being actuated in response to receiving signals from the liquid level sensing, signaling element indicating the termination of filling of the holding tank and responsively causing the control valve to close at a preselected time after actuation thereby terminating air flow through the control valve when liquid is not being moved from the supply tank to the holding tank.

3. An apparatus, as set forth in claim 2, wherein the holding tank is the foam tank of a fire truck.

4. An apparatus, as set forth in claim 2 including a pressure regulator connected to the control valve and the pressurized air source and being adapted to control the air pressure passing through the control valve.

* * * * *